United States Patent [19]

Hodson

[11] Patent Number: 4,768,612

[45] Date of Patent: Sep. 6, 1988

[54] FETAL COMMUNICATION DEVICE

[76] Inventor: Janet D. Hodson, 3321 Preble St., Ventura, Calif. 93003

[21] Appl. No.: 57,329

[22] Filed: Jun. 4, 1987

Related U.S. Application Data

[63] Continuation-in-part of Ser. No. 920,952, Oct. 20, 1986.

[51] Int. Cl.[4] ..... G10K 11/00

[52] U.S. Cl. ..... 181/21; 181/22

[58] Field of Search ..... 181/18, 20–22, 181/126

[56] References Cited

U.S. PATENT DOCUMENTS

| | | | |
|---|---|---|---|
| 434,672 | 8/1890 | Mersick | 181/21 |
| 453,848 | 9/1891 | Peirce | 181/20 |
| 453,919 | 10/1891 | Schluchtner | 181/20 |
| 523,536 | 6/1894 | Leech | 181/128 |
| 652,926 | 9/1900 | Salmond | 181/20 |
| 771,642 | 4/1904 | Jardine | 181/20 |
| 1,633,705 | 6/1927 | McKesson | 181/18 X |
| 2,099,871 | 11/1937 | Stern | 181/18 X |
| 3,497,809 | 2/1970 | Greenberg | 181/20 X |

OTHER PUBLICATIONS

Carton "Cathy", by Cathy Guisewite, 2/4/86, 2/5/86 and 4/1/86.

Article entitled "Contacting the Unborn Baby", Santa Barbara News Press, Jan. 6, 1986.

*Primary Examiner*—B. R. Fuller

*Attorney, Agent, or Firm*—Milton S. Gerstein

[57] ABSTRACT

A device for allowing for spoken communication between a pregnant woman and her fetus. The device has a speaking tube component connected at one of its ends to a mouthpiece component and at its other end to a stomach-piece, megaphone-type component. The speaking tube component is made of flexible and soft plastic to allow for reconfiguration to suit the size and stage of pregnancy of the woman. The stomach-piece component has a canted annular edge surface to allow flush positioning against the stomach. The pregnant woman speaks into the mouthpiece, the sounds being amplified and sent to the megaphone-type component positioned against the abdomen so the fetus may hear.

13 Claims, 2 Drawing Sheets

FETAL COMMUNICATION DEVICE

This is a continuation-in-part of application Ser. No. 920,952, filed on Oct. 20, 1986.

BACKGROUND OF THE INVENTION

The present invention is directed to a device for allowing a pregnant woman, or other people, to audibly communicate with the fetus. Recent experiments and research have shown that at approximately six months of gestation, the human fetus is capable of not only hearing sounds but also discriminating among them. These experiments have also shown that a prenatal bond between a father and the fetus is possible by repeated audible communication by the father which is accomplished by speaking directly to the fetus directly adjacent to the abdomen of the mother. These studies have also shown that a fetus is able to acquire some learning, albeit minimal, by exposure to ambient aural stimulation, with the requirement being that the intensity of such sound be at least 80 decibels in a plane constituting entrance of the sound at the abdomen. However, the one person to whom prenatal bonding via oral communication would be most meaningful, mainly the mother, is the one which at present finds it most difficult simply because she is not able to speak directly in front of the abdomen, in contrast to all others.

SUMMARY OF THE INVENTION

It is, therefore, the primary objective of the present invention to provide a device for allowing direct oral communication by a pregnant woman with her fetus, with such communication being achieved by normal or below normal intensity levels of speech.

It is another objective of the present invention to allow for such communication between a pregnant woman and her fetus in a manner that will ensure the proper intensity level of the sound at the entrance plane constituted by the outer surface of the abdomen.

It is still another objective of the present invention to provide such a device that will provide a source of sound at the entrance plane constituted by the outer surface of the abdomen that is at least 80 db. in intensity for normal and below normal intensities of the spoken sounds uttered by the pregnant woman.

It is yet another objective of the present invention to allow for such device to be adaptable in order to allow use by all pregnant women during the last five months of pregnancy, such device being readily conformable to suit the particular physical requirements.

Toward these and other ends, the fetal communication device of the present invention consists of three primary components: A mouthpiece, a funnel shaped portion for resting against the abdomen, and a speaking tube interconnecting the other two portions. The speaking tube portion, in the preferred embodiment,is made of a soft plastic to allow for a multitude of different arcuate forms for the speaking tube, in order to permit use of the device by both large and small pregnant women, and regardless of stage of pregnancy. Also, preferably the other two components are made of the same soft plastic. The speaking tube is preferably circular in cross section within a range of between 0.5 inches and 1.5 inches in diameter, with a length of approximately two feet, thus allowing the funnel shaped portion ample freedom for fitting flush against the abdomen. The speaking tube diameter is so chosen so as to provide resonance to intensify the spoken sounds of the mother, as well as to ensure the least amount of impedance associated therewith. The funnel shaped portion is an eccentric funnel defining a sloped or canted planar edge, which edge is defined by the exit plane thereof, in order to allow for a flush fitting of the funnel against the abdomen. In the preferred embodiment the diameter of the exit plane of the funnel is 4 inches.

DETAILED DESCRIPTION OF THE INVENTION

Figures 1, 2, 3:
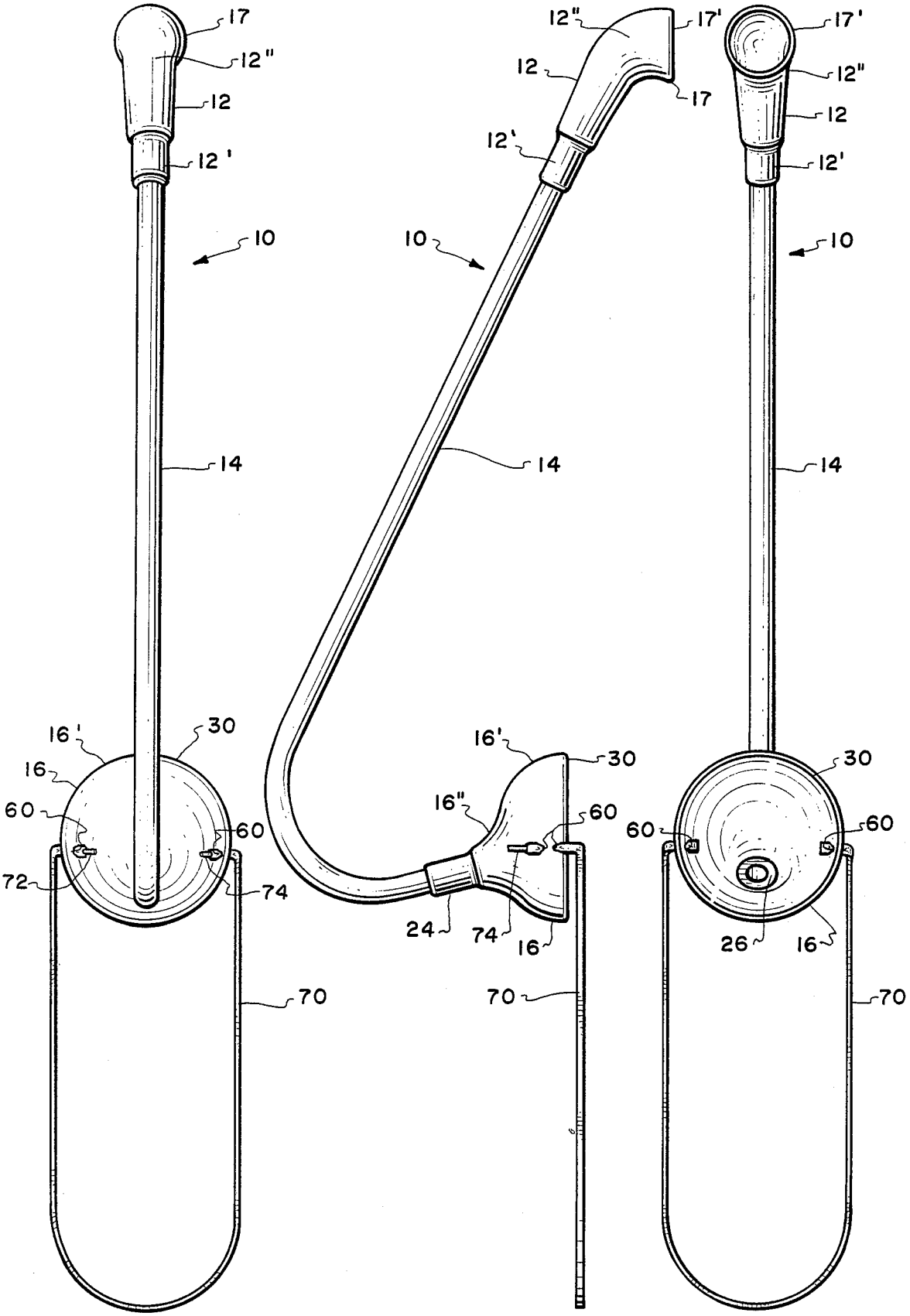
FIG. 1 is a front elevational view of the fetal communication device of the invention.
FIG. 2 is a side elevational view thereof.
FIG. 3 is a rear elevational view thereof.
Figure 4:
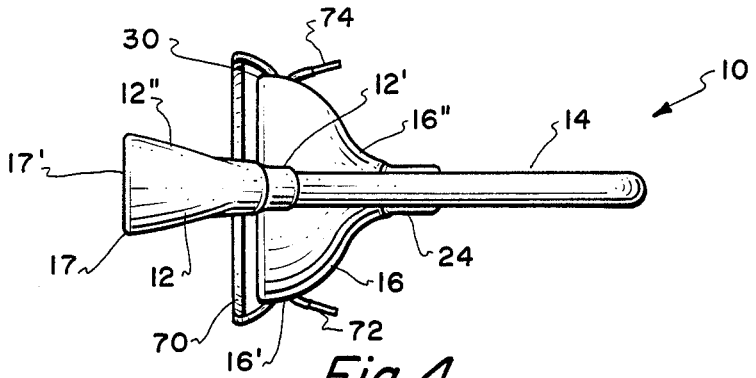
FIG. 4 is a top plan view thereof.
Figure 5:
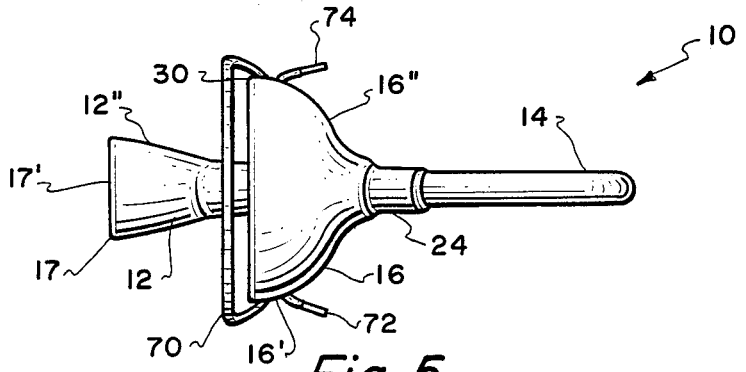
FIG. 5 is a bottom view thereof.

According to the invention, in order to allow a pregnant woman to communicate orally with her fetus there is provided a speaking tube indicated generally by reference numeral 10 shown in the drawings. The speaking tube 10 consists of three main portions, which portions are removably connected, the three portions being: A mouthpiece component 12; an elongated, flexible circular tube component 14; and funnel-shaped, end-piece component 16.

It is known that the human ear is capable of hearing within the so-called "audible" range of between 20 cycles/second and 20,000 cycles/second. Regarding human speech itself, it is known that most intelligible speech lies within the range of between 500 cps and 4,000 cps. It is also known that the average total sound level of human speech is approximately 68 db, it being understood that the absolute intensity at a respective frequency of the spoken utterance will vary, such that the general rule being within the range of between 500 cps and 4,000 cps that intensity in decibels decreases with increasing frequency. Since it is also known, as stated above, that a minimum sound intensity of 80 db is required at the entrance plane constituted by the outer surface of the abdomen, the present invention provides sound amplification to the spoken utterances of the pregnant woman commencing at the mouth of the woman to such a degree that it is amplified to at least the 80 db level at the entrance plane, to ensure the fetus will receive aural stimulation via the abdomen and amniotic fluid. The human speech range of between 500 cps and 4,000 cps corresponds to a wave length range of between 2.2 feet (0.66 meters) and 3.25 inches (0.08 meters); thus, the speaker tube component 14 of the invention has been chosen to have a diametric extension that is at least less than 50% of the minimum wave length of the human speech range. In the preferred embodiment, the component 14 is circular and has a diameter of 1 inch, with an effectice range of component 14 being between 0.5 inches and 1.5 inches. The reason for this restriction is to ensure that the wave lengths of the spoken utterances of the mother's voice will be considerably greater than the diameter of the tube 14, in order to minimize impedance transmission loss, so that the propogation of the sound waves in the tube 14 occurs almost exclusively parallel to the longitudinal axis 14. Regarding this impedance, Kirchhoff's formula for the attenuation constant in circular tubes is as follows:

$$G = \frac{1.02}{c} \frac{f^2}{R} \text{ nepers/cm.}$$

This equation clearly shows that the larger the radius of the tube the greater the attenuation, while the higher the frequency (the shorter the wavelength) the greater the attenuation. Thus, there is a tradeoff between increasing the radius of the tube to minimize attenuation yet decreasing the radius in order to ensure the wavelengths of the transmitted sound are considerably greater than the diameter of the tube. For the present invention, it has been found that the optimal range of the tube 14 is between 0.7 inches and 1.0 inches, which range minimizes attenuation according to Kirchhoff's equation and yet ensures the wavelengths of the transmitted sound are considerably greater than this range.

Figure 6:
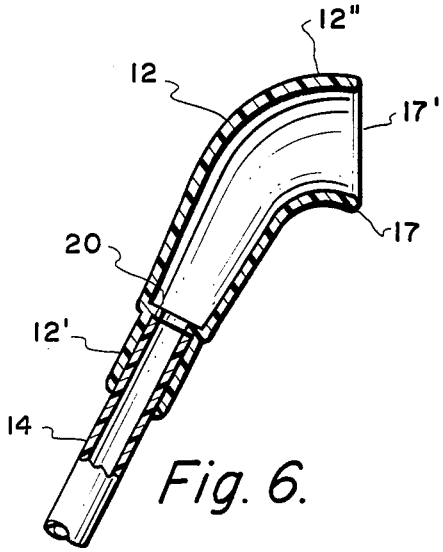
FIG. 6 is a detailed view, in cross section, of the mouthpiece of the invention.

Referring now to the drawings, the component pieces are removably coupled to each other. The mouthpiece component 12, best seen in FIG. 6, includes an inner annular ring or bead 20 formed along the circumferential interior surface of the mouthpiece somewhat adjacent to the end 12' thereof. The diameter of the end 12' allows for a snug fitting of the end of the tube component 14 therein, with inner bead 20 providing a limit stop for the end of the tube. The remainder of the mouthpiece 12 consists of a substantially frustro-conical shaped portion 12" which has eccentric flared portion 17 defining at its open end the originating plane through which the spoken utterance of the pregnant woman start, it being understood that the originating plane 17' is to be juxtaposed against the woman's mouth or up to 4 inches away from her mouth.

Figure 7:
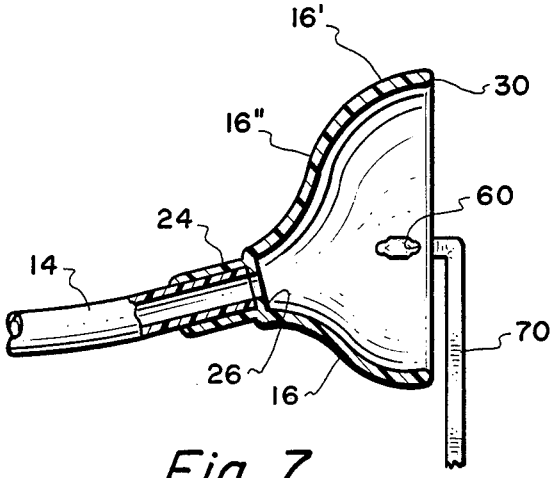
FIG. 7 is a detailed view, in cross section, of the funnel shaped end portion.

The funnel-shaped end component 16 is best seen in FIG. 7 and includes a tubular first end portion 24 which receives snugly therein the other end of the tube component 14. An inner, circular bead or ring 26 is also provided, similar to the bead or ring 20, to serve as a limit stop to the insertion of the other end of the tube component. The funnel-shaped component 16 is eccentric in form as can be seen in FIG. 7, in that the upper half portion 16' is unsymetrical with the half-portion 16". The half-portion 16' has a greater radius of curvature than the half-portion 16". Futhermore, the end face of the entire funnel-shaped component 16 forms an acute angle with respect to the longitudinal center line of the end portion 24, so as to define an annular edge surface 30 that is sloped at approximately 20° with respect to the vertical. This allows for a flush positioning of the circular edge 30 against the outer surface of the abdomen, which edge surface constitutes the entrance plane for the propogated sound to the abdomen.

Each of the three components is preferably made of a soft plastic to allow for the deformation thereof for reconfiguring the curvature of the speaking tube component 14, so that the device 10 may be used by all women regardless of size and regardless of stage of pregnancy. Futhermore, use of the soft plastic allows for the insertion of each end of the speaking tube component 14 into the respective end portions 12' and 24 by squeezing the respective end of the tube. The thickness of the tube 14, as defined by its annular wall, is approximately 3/32 in. This thickness ensures an inner circumferencial wall that for all intents and purposes is rigid to thus minimize impedance losses, it being understood that although the material itself is soft plastic, it is relatively rigid to a transmitted sound wave.

It may be seen that when using the device 10, the funnel-shaped, stomach piece component 16 is placed against the abdomen, against the outer surface thereof at a location directly opposite the fetus, while the mouthpiece component 12 is placed against the mouth, with the speaking tube component 14 automatically assuming a curvature allowing for the emplacements of the other two components.

The stomach, end-piece component 16 is also provided with a strap 70 for securing the component 16 to the front of the abdomen. The strap 70 has a pair of ends 72, 74 which include plastic inserts for threading the respective ends through a pair of holes or openings 80 of the component 16. Preferably, the diameter of each hole 60 is slightly less than the normal diametric expanse of the strap 70, so that when the ends of the strap are threaded through the holes 80, and pulled therethrough, there is provided a force-fit connection for holding the ends of the strap in place, yet allow for easy removal thereof as well. Thus an easy and safe manner of securing and removing the stomach-piece component 16 to the abdomen is achieved. The strap 70 may be elastic or flexible. One of the ends 72, 74 may be permanently secured to one of the holes 60, as by tieing a knot after insertion through the hole.

While a specific embodiment of the invention has been shown and described, it is to be understood that numerous changes and modifications may be made therein without departing from the scope, spirit, and intent of the invention, as set out in the appended claims. For example, the interconnections between the three separate components 12, 14 and 10 may be achieved by making the speaking tube component the one that receives telescopingly therein the tubular end portions of the other two components 14, 16, with each end of the speaking tube component having an interior annular ring or bead similar to the beads 20, 26.

The device is made out of "PLASTISOLE", a polyvinyl chloride resin with plasticizers and stabilizers.

What is claimed is:

1. A device for allowing aural communication between a pregnant woman and her fetus, comprising:

a first hollow mouthpiece component into which a person speaks;

a second hollow speaking-tube component for directing the spoken utterance from said first mouthpiece component;

a third hollow stomach component for placement against the abdomen of the pregnant woman;

said second component having a first end coupled to said first component and a second end coupled to said third component, said second component being made of a flexible material so as to be able to take on a variety of curved forms;

said third component defining a hollow interior and having a first end for coupling to said second end of said second component and a second end, said second end of said third component having a canted end-face, said end-face being defined by an annular edge-surface contained in an imaginary plane forming an acute angle with respect to a line passing through the center of said first end of said third component, whereby said third component may be placed snugly against the outer portion of the abdomen of the pregnant woman;

said first end of said third component defining a hollow interior and a central longitudinal axis, said second end of said second component also having a hollow interior and a central longitudinal axis colinear with said central longitudinal axis of said first end of said third component, so that said second end of said second component and said first end of said third component extend substantially colinear.

2. The device according to claim 1, wherein said components are removably connected to each other; said first end of said third component having a first tubular extension for coupling to said second end of said second component.

3. The device according to claim 2, wherein said first component comprises a second tubular extension for coupling with said first end of said second component; each of said first and second tubular extensions comprising an inner, annular bead; the respective said end of said second component being telescopingly received in the respective said first and second tubular extensions, with the passage therein being limited by the respective said inner annular bead.

4. The device according to claim 3, wherein each of said first and second tubular extensions is made of a flexible and soft material to allow for insertion therein of the respective said end of said second component, each said tubular extension having an inner diametric extension less than the diametric extension of said first and second ends of said second component to allow for a force-fitting of said ends of said second component into the respective said tubular extensions.

5. The device according to claim 4, wherein each of said components is made of a soft plastic to allow for the deformation and compression thereof.

6. The device according to claim 1, wherein said third component is eccentric and comprises a main body portion having a hollow interior, and a second tubular end portion; said tubular end portion defining a longitudinal axis thereof; said main body portion having a first half-shell section defining a first contoured shape, and a second half-shell section defining a second contoured shape, said first contoured shape being different from said second contoured shape.

7. The device according to claim 6, wherein said first contoured shape defines a larger interior volume than said second contoured shape, said first contoured shape having a larger radius of curvature than said second contoured shape.

8. The device according to claim 7, wherein each said half-shell section defines an annular end edge-surface together forming said canted end-face of said third component.

9. The device according to claim 1, further comprising strap means for attaching said third component to the abdomen of the pregnant woman.

10. The device according to claim 9, wherein said strap means comprises a first end and a second end, said third component comprising at least one pair of holes through which pass said first and second ends of said strap means for securing said strap means to said third component.

11. The device according to claim 10, wherein each of said first and second ends of said strap means comprising a threading means for insertion of the respective said end through one of said pair of holes; the diametric extension of each of said pair of holes being smaller than the diametric extension of said strap means so that said strap means may be held therein.

12. The device according to claim 1, wherein said second component is circular and has a diameter of between 0.5 inches and 1.5 inches, and a length of between 1.5 and 2.5 feet, so as ensure that the wavelength of each major frequency sound of the pregnant woman is substantially greater than the diameter of the second component.

13. A device for allowing aural communication between a pregnant woman and her fetus, comprising:

a first hollow mouthpiece component into which a person speaks;

a second hollow speaking-tube component for directing the spoken utterance from said first mouthpiece component;

a third hollow stomach component for placement against the abdomen of the pregnant woman;

said second component having a first end coupled to said first component and a second end coupled to said third component, said second component being made of a flexible material so as to be able to take on a variety of curved forms;

said third component defining a hollow interior and having a first end for coupling to said second end of said second component, and a second end, said second end of said third component having a canted end-face, said end-face being defined by an annular edge-surface contained in an imaginary plane forming an acute angle with respect to a line passing through the center of said first end of said third component, whereby said third component may be placed snugly against the outer portion of the abdomen of the pregnant woman;

said third component further comprising strap means for attaching said third component to the abdomen of a pregnant woman.

* * * * *